US005305909A

United States Patent [19]

Merritt

[11] Patent Number: 5,305,909

[45] Date of Patent: Apr. 26, 1994

[54] METHOD AND DEVICE FOR PROTECTING PAINT IN A PAINT CONTAINER

[76] Inventor: James A. Merritt, 4141 Foothill Rd., Pleasanton, Calif. 94566

[21] Appl. No.: 7,460

[22] Filed: Jan. 22, 1993

[51] Int. Cl.[5] ..... B65D 88/34

[52] U.S. Cl. ..... 220/579; 220/216; 220/256; 220/404; 220/578; 222/386.5

[58] Field of Search ..... 220/200, 216, 256, 578, 220/579, 403, 404, 720, 723; 222/386.5

[56] References Cited

U.S. PATENT DOCUMENTS

| | | | |
|---|---|---|---|
| 1,818,924 | 8/1931 | Basmadjian . | |
| 2,465,755 | 3/1949 | Sanders | 220/578 X |
| 2,556,195 | 6/1951 | Kors . | |
| 2,609,119 | 9/1952 | Shilstone . | |
| 2,751,073 | 6/1956 | Sheeran | 220/578 X |
| 3,266,662 | 8/1966 | Craig . | |
| 4,625,883 | 12/1986 | Burke et al. | 220/578 |
| 4,625,886 | 12/1986 | Eisenman . | |
| 4,723,674 | 2/1988 | Nunes . | |

FOREIGN PATENT DOCUMENTS

| | | |
|---|---|---|
| 2832510 | 2/1980 | Fed. Rep. of Germany . |
| 1372631 | 8/1964 | France . |

*Primary Examiner*—Allan N. Shoap
*Assistant Examiner*—Nova Stucker
*Attorney, Agent, or Firm*—Townsend & Townsend Khourie & Crew

[57] ABSTRACT

A paint container assembly including a container body (8) having an outer surface (10), an inner surface (12) defining an interior (14) containing the paint (16), an opening (20) through which the paint is removed, and a flexible bag (6). The flexible bag (6) has a bottom region (28) used to cover a free surface (18) of the paint (16) and a sidewall region (28) sized to cover the inner surface (12) of the container, a lid mating surface (22), and a portion of the outer surface (10) of the container body (8).

11 Claims, 2 Drawing Sheets

METHOD AND DEVICE FOR PROTECTING PAINT IN A PAINT CONTAINER

BACKGROUND OF THE INVENTION

When paint is exposed to air, volatile elements of the paint evaporate and an undesirable crust forms. The thickness of the crust increases over time. The crust will form on all exposed paint surfaces including the interior surface of the container and the free surface of the paint. Thus, paint containers must be substantially air tight to protect the paint in the container from being exposed to air.

Known paint containers include a lid for sealing the container. The lid is removed to access the paint and replaced after removing the desired quantity of paint.

A problem with known paint containers is that after a portion of the paint has been used the container will trap an amount of air equal to the volume of used paint. As mentioned above, the trapped air will cause a crust to form on the interior surface of the container and the free surface of the paint. This problem becomes worse as more paint is removed since the volume of trapped air increases.

A further problem with known paint containers is adherence of the lid to the paint container. Paint is often splattered on the lid mating surface when paint is removed from the container. When the lid is thereafter placed on the lid mating surface the paint trapped between the lid and the lid mating surface hardens over time making removal of the lid more difficult. Also, when the lid is replaced on the container, the lid is often re-sealed using a hammer; this often causes paint in the lid mating surface to spray out onto the painter or onto the surrounding support surface.

Yet another problem with known paint containers is the problem of an imperfect seal between the lid mating surface and the lid due to paint drying on the lid mating surface. An imperfect seal allows air to enter into the container and lead to the above-mentioned crust formation. Simply chipping away paint which dries on the lid mating surface is not a solution to this problem since the dried paint is often discolored. If the dried paint is chipped away, some of the chipped paint will inevitably fall back into the container. The discolored paint which falls into the container will change the color of the paint so that paint from the container will no longer match the color of previous paint applications from that same container.

Several known devices for protecting paint in a paint container provide rigid disks which float on the surface of the paint. One such device is disclosed in U.S. Pat. No. 4,625,886 to Eisenman. A problem with devices using rigid floating disks is that the disk must be smaller than the opening to insert the disk into the container. This necessarily leaves an annular space adjacent the interior surface which is exposed to air trapped in the container. A further problem with floating paint protection devices is that they do not address the problem of a crust forming on the inner surface of the container nor do they address the problem of adherence of the lid to the container body.

Another known paint protection device is disclosed in U.S. Pat. No. 2,609,119 to Shilstone. Shilstone discloses a flexible protective cover for preventing the formation of a crust. The protective cover includes a disk and a projecting flange. A problem with Shilstone is that the cover does not protect the entire interior surface of the paint container when the paint level is below the level shown in FIGS. 4–6. Furthermore, Shilstone also does not address the problem of adherence of the lid to the lid mating surface nor the problem of crust formation at the lid mating surface.

SUMMARY OF THE INVENTION

The problem of protecting paint contained in a paint container from air, the problem of adherence of the lid to the lid mating surface, the problem of paint spray when replacing the lid, and the problem of crust formation at the lid mating surface are overcome in accordance with the present invention by providing a paint container assembly including a flexible bag. The paint container assembly includes a container body having an outer surface, an inner surface defining an interior containing the paint, and an opening through which the paint is removed. A lid mating surface surrounds the opening and is configured to matingly engage a lid.

The paint container assembly also includes a flexible bag. The flexible bag has a bottom region sized to cover the free surface of the paint and a sidewall region sized to cover the inner surface of the container above the free surface of the paint, the lid mating surface, and a portion of the outer surface of the container. The flexible bag isolates the paint from air trapped in the container and also protects the paint form any air which might leak past the lid.

To use the paint container assembly, the bottom of the flexible bag is placed over the container opening and the sidewall is draped over the outer surface of the container. The bottom region of the flexible bag is pressed into contact with the free surface of the paint so that the sidewall portion covers the inner surface of the container above the free surface of the paint. The paint container assembly may also include a pusher element preferably having a substantially flat surface for pressing the flexible bag into the paint. The remainder of the sidewall covers the lid mating surface and a portion of the outer surface of the paint container.

Once in position, the flexible bag isolates the free surface of the paint and the inner surface of the container from air in the container body. Isolating the paint from air in the container reduces the aforementioned problem of crust formation.

The flexible bag also serves to reduce adherence of the lid by providing the sidewall portion which extends over the lid mating surface of the container body. Preferably, the flexible bag is made of a material which paint does not stick to so that the lid mating surface and lid do not stick to the flexible bag. The flexible bag also reduces the problem of crust formation at the lid mating surface since excess paint is expelled from the lid mating surface by the flexible bag when the lid is pressed downwardly onto the flexible bag and the lid mating surface for sealing the opening. Since the flexible bag drapes over the upper edge of the paint container, splattering of paint when the lid is replaced is prevented.

Other features and advantages of the invention will appear from the following description in which the preferred embodiment has been set forth in detail in conjunction with the accompanying drawings.

DESCRIPTION OF THE PREFERRED EMBODIMENT

Figure 1:
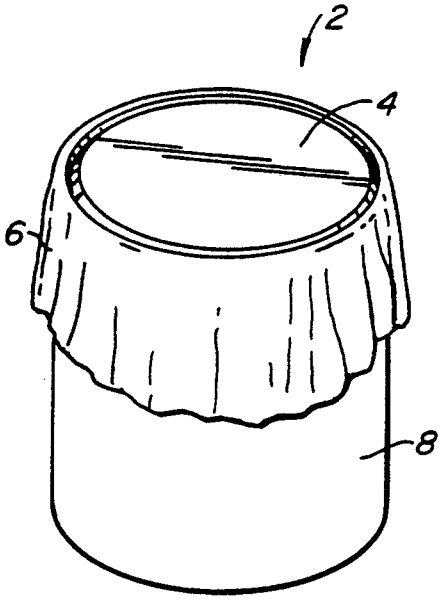
FIG. 1 is a side view of a paint container assembly.

FIG. 1 shows a paint container assembly 2. Paint container assembly 2 includes a lid 4. Lid 4 matingly engages a container body 8 which contains a paint 16 (not shown). A flexible bag 6 is positioned between lid 4 and container body 8. Flexible bag 6 protects paint 16 in container body 8 from air trapped in container body 8 and from any air which might leak past lid 4.

Figure 2:
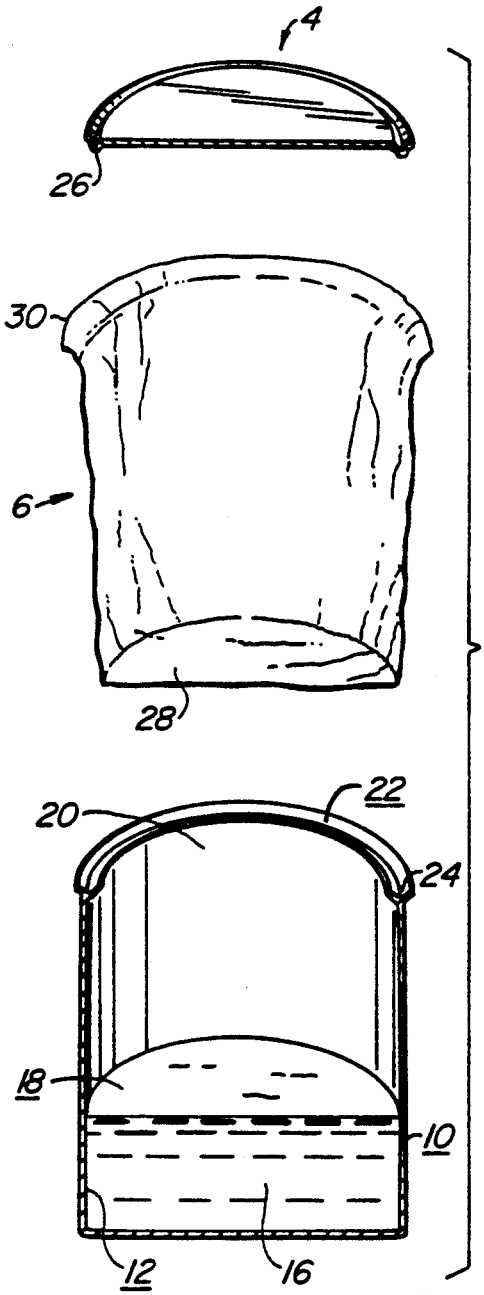
FIG. 2 is an exploded cross section of the paint container assembly.

FIG. 2 is an exploded cross section of paint container assembly 2. Container body 8 has an outer surface 10 and an inner surface 12. An interior 14 of container body 8 contains paint 16 having a free surface 18. Paint 16 is removed through an opening 20. Opening 20 is surrounded by a lid mating surface 22 which is configured to matingly engage lid 4. Lid mating surface 22 includes a circumferential channel 24 which accepts a complementary shaped lip 26 of lid 4. Container body 8 is, in this embodiment, a standard one gallon container.

Flexible bag 6 isolates free surface 18 of paint 16 and inner surface 12 from air trapped in interior 14 of container body 8. Flexible bag 6 is preferably shaped to conform to the size of container body 8 to minimize bunching up of the material at free surface 18 and lid mating surface 22. Minimizing bunching up of flexible bag 6 at free surface 18 minimizes air trapped between flexible bag 6 and thereby minimizes crust formation. Minimizing bunching at lid mating surface helps to create a good seal between lid mating surface 22, flexible bag 6, and lid 4.

In the preferred embodiment of FIG. 2, flexible bag 6 includes a bottom region 28 used to cover free surface 18. The perimeter of flexible bag 6 defines an open edge 30. Flexible bag 6 also has a sidewall region 28 sized to cover at least inner surface 12 above free surface 18, lid mating surface 20, and a portion of outer surface 10. Flexible bag 6 is preferably substantially impermeable to air and has a preferred thickness between 0.00025 inches and 0.03 inches. Flexible bag 6 is also preferably made of a material which paint 16 does not stick to so that lid 4 and lid mating surface 20 do not stick to flexible bag 6.

To use paint container assembly 2, flexible bag 6 is draped over opening 20 so that open edge 30 is adjacent outer surface 10 and bottom region 28 of flexible bag 6 is positioned over lid mating surface 22. Bottom region 28 is then pressed into contact with free surface 18. Once flexible bag 6 is in position lid 4 is placed over lid mating surface 22 to seal container body 8.

Figure 3:
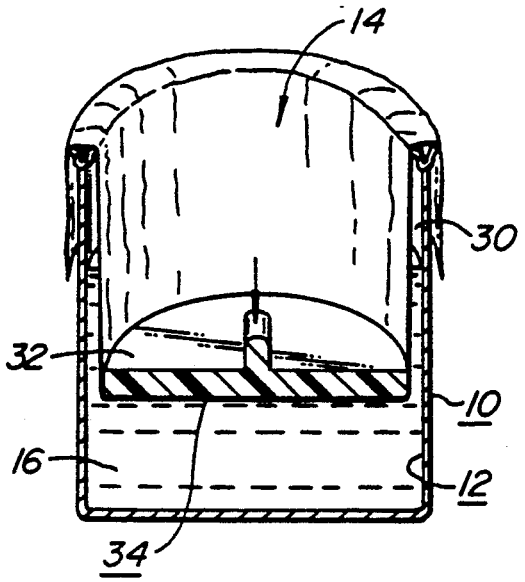
FIG. 3 is a paint container assembly including a pusher element having a substantially flat surface for pressing the flexible bag into the paint.

Preferably, bottom region 28 is pressed downwardly into paint 16 so that free surface 18 rises up inner surface 12 of container body 8 thereby expelling air from a space 30 between flexible bag 6, inner surface 12, and free surface 18. Pressing of bottom region 28 into free surface 18 is shown in FIG. 3 in conjunction with an further embodiment of the invention described below. Expelling as much air as possible from space 30 minimizes crust formation. After pressing bottom region 28 downwardly into paint 16 the pressure on bottom region 28 is released so that paint 16 reestablishes free surface 18 with flexible bag 6 adhering to substantially the entire free surface 18 while sidewall region 28 isolates inner surface 12 from air in interior 14 of container body 8.

Flexible bag 6 advantageously reduces formation of a crust at lid mating surface 22 so that a relatively good seal can be maintained for subsequent uses. Opening 20 is sealed by capturing flexible bag 6 between lid 4 and lid mating surface 22. When lid 4 is pressed downwardly, flexible bag 6 is pressed into contact with channel 24 and lip 26. The compressive force expels paint from channel 24. Reducing the amount of paint trapped in channel 24 reduces crust formation at lid mating surface 22 and helps to ensure a proper seal between lid 4, flexible bag 6, and lid mating surface 22 during subsequent uses of paint container assembly 2.

FIG. 3 illustrates another embodiment of the invention including a pusher element 32 for pressing bottom region 28 into contact with free surface 18. Preferably, pusher element 32 includes a substantially flat surface 34 sized smaller than opening 20 so that pusher element 32 may be introduced into interior 14. Pusher element 32 is used to press bottom region 28 into paint 16 for expelling air as explained above. As shown in FIG. 3, when pusher element is pressed downwardly free surface 18 rises up inner surface 12 and expels air from space 30.

Figure 4:
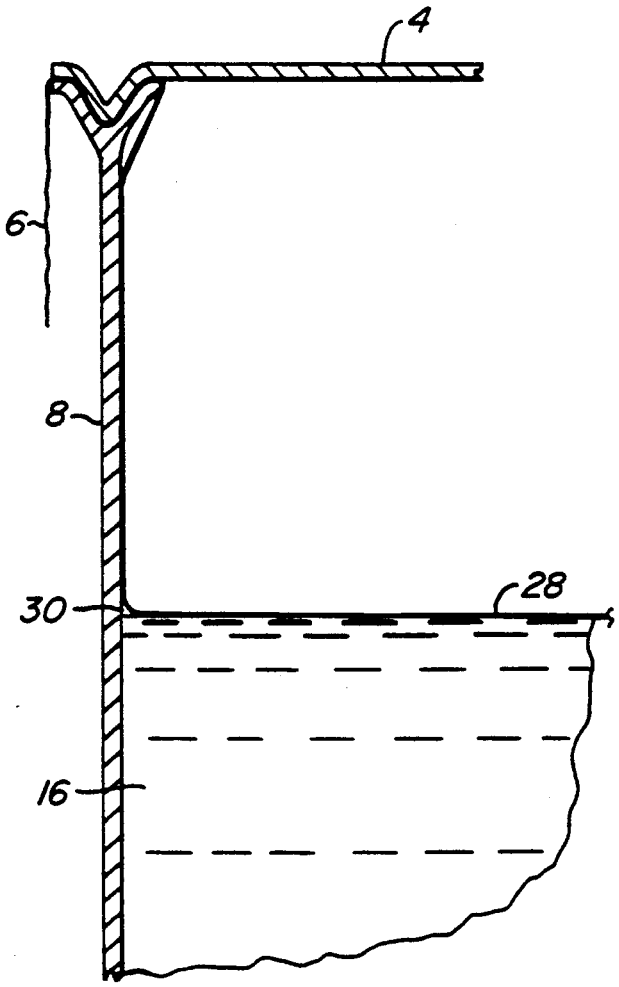
FIG. 4 is an enlarged cross sectional view of the paint container assembly along a portion of the flexible bag.

FIG. 4 shows flexible bag 6 adhering to inner surface 12 and free surface 18 after pressing bottom region 28 into free surface 18. Preferably, as much air is expelled from space 30 as possible. Adherence of flexible bag 6 to inner surface 12, as shown in FIG. 4, protects paint 16 from air which might leak past lid 4.

Modification and variation can be made to the disclosed embodiments without departing form the subject of the invention as defined by the following claims. For example, flexible bag 6 may be cut from a flat sheet of material with bottom region 2 being defined by the general shape of free surface 18 or pusher element 32 could have a curved surface rather than substantially flat surface 34. Also, the invention could be used to help protect liquids other than paint. In some situations it may not be necessary to replace the lid after placing flexible bag 6 in place.

What is claimed is:

1. A liquid container assembly comprising:

a container body having an opening through which a liquid is removed, a lid mating surface having an upwardly-opening circumferential channel surrounding the opening, an outer surface, and an inner surface defining an interior containing the liquid, the liquid having a free surface;

a lid having a downwardly extending circumferential lip configured to matingly engage the circumferential channel of the lid mating surface;

a flexible bag having a bottom region sized to cover the free surface of the liquid and a sidewall region sized to cover at least a substantial part of the inner surface above the free surface of the liquid, the lid mating surface, and at least a portion of the outer surface of the container body regardless of the liquid level within the container body, the sidewall extending substantially perpendicular to the bottom region, whereby outward splashing of any liquid from the circumferential channel when the circumferential lip is pressed into engagement with the circumferential channel is blocked by the sidewall covering the portion of the outer surface of the container.

2. The liquid container assembly of claim 1 wherein the flexible bag is substantially impermeable to air.

3. The liquid container assembly of claim 1 wherein the flexible bag has a thickness in a range of 0.00025 inches to 0.03 inches.

4. The liquid container assembly device of claim 1 wherein the flexible bag is made of a material which the liquid does not stick to so that the lid mating surface and the lid do not adhere to the flexible bag.

5. The liquid container assembly of claim 1 further comprising means for pressing the flexible bag into contact with the free surface of the liquid.

6. The liquid container assembly device of claim 5 wherein the pressing means includes a substantially flat surface sized to fit through the opening so that the flexible bag can be pressed into contact with the free surface of the liquid.

7. A method for protecting a liquid contained in a liquid container comprising the steps of:

providing a flexible bag and a liquid container, the flexible bag having an open edge, a sidewall, and a bottom region opposite the open edge, the sidewall being connected to the bottom region at one end and defining the open edge at an opposite end, the sidewall extended substantially perpendicular to the bottom region, the liquid container including an outer surface, an inner surface defining an interior containing the liquid, an opening through which the liquid is removed, a lid mating surface having an upwardly-opening circumferential channel surrounding the opening, and a lid having a downwardly-extending circumferential lip configured to matingly engage the (lid mating surface) circumferential channel, the liquid in the liquid container having a free surface;

draping the open edge of the flexible bag over the liquid container so that the open edge and sidewall are adjacent the outer surface and the bottom region of the bag is positioned over the opening;

pressing the bottom region of the flexible bag into contact with the free surface of the liquid;

registering the circumferential lip with the circumferential channel with the bag therebetween; and sealing the opening by capturing the bag between the lid and the circmferential channel with the circumferential lip engaged within the circumferential channel, the draping step preventing outward splashing of any liquid from the circumferential channel.

8. The method for protecting liquid contained in a liquid container of claim 7 wherein the pressing step is carried out using a pusher element having a substantially flat surface sized smaller than the opening.

9. The method for protecting liquid contained in a liquid container of claim 7 wherein the positioning step is carried out using a substantially air impermeable flexible bag.

10. The method of protecting liquid contained in a liquid container of claim 7 wherein the pressing step includes the steps of:

pushing the bottom region of the bag into the liquid so that liquid rises up in the a space between the inner surface of the liquid container and the bag, thereby expelling air from the space; and releasing the bag so that the liquid reestablishes the free surface with the bag adhering to substantially the entire free surface of the liquid.

11. A method for protecting paint contained in a paint container comprising the steps of:

providing a flexible bag and a paint container, the flexible bag having an open edge, a sidewall, and a bottom region opposite the open edge, the sidewall being connected to the bottom region at one end and defining the open edge at an opposite end, the sidwall extended substantially perpendicular to the bottom region, the paint container including an outer surface, an inner surface defining an interior containing the paint, an opening through which paint is removed, a lid mating surface having an upwardly-opening circumferential channel surrounding the opening, and a lid having a downwardly-extending circumferential lip configured to matingly engage the circumferential channel, the paint in the paint container having a free surface, selecting a material for the flexible bag which is substantially impermeable to air;

draping the open edge of the flexible bag over the paint container so that the open edge is adjacent the outer surface and the bottom region of the bag is positioned over the opening;

pressing the bottom region of the flexible bag through the opening and into contact with the free surface of the paint;

pushing the bottom region of the bag into the paint so that paint rises up the in a space between the inner surface of the paint container and the bag, thereby expelling air from the space;

releasing the bag so that the paint reestablishes the free surface with the bag adhering to substantially the entire free surface of the paint;

registering the circumferential lip with the circumferential channel with the bag therebetween; and sealing the opening by pressing the lid onto the lid mating surface, the draping step preventing outward splashing of any paint from the upwardly opening circumferential channel during the sealing step.

* * * * *